US008398435B2

(12) United States Patent
Aurongzeb et al.

(10) Patent No.: US 8,398,435 B2
(45) **Date of Patent: *Mar. 19, 2013**

(54) RECEPTACLE CONNECTOR BETWEEN CONTROLLER AND LIGHTING FIXTURE

(75) Inventors: Deeder Aurongzeb, Round Rock, TX (US); Laszlo Ilyes, Richmond Heights, OH (US); Tony Aboumrad, Parma, OH (US); Jason Creighton, Twinsburg, OH (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/224,698

(22) Filed: Sep. 2, 2011

(65) Prior Publication Data

US 2012/0282815 A1 Nov. 8, 2012

Related U.S. Application Data

(63) Continuation-in-part of application No. 13/101,577, filed on May 5, 2011, now Pat. No. 8,038,481.

(51) Int. Cl.
*H01R 13/648* (2006.01)

(52) U.S. Cl. ..... 439/607.41

(58) Field of Classification Search ..... 439/607.41, 439/607.5, 607.51, 607.52
See application file for complete search history.

(56) References Cited

U.S. PATENT DOCUMENTS

| | | | | |
|---|---|---|---|---|
| 4,477,143 | A | 10/1984 | Taylor | |
| 4,653,834 | A | 3/1987 | Norden | |
| 5,593,318 | A | 1/1997 | Bilson et al. | |
| 5,647,751 | A | 7/1997 | Shulman et al. | |
| 6,328,581 | B1 * | 12/2001 | Lee et al. | 439/106 |
| 7,144,260 | B2 * | 12/2006 | Murayama et al. | 439/108 |
| 7,307,514 | B2 | 12/2007 | McAden | |
| 7,322,702 | B2 | 1/2008 | Shimizu | |
| 7,493,100 | B2 | 2/2009 | Welles, II et al. | |
| 7,548,223 | B2 | 6/2009 | Brooksby et al. | |
| 7,622,701 | B2 | 11/2009 | Stevens et al. | |
| 7,637,766 | B2 | 12/2009 | Kauffman et al. | |
| 7,828,463 | B1 | 11/2010 | Willis | |
| 8,038,481 | B1 * | 10/2011 | Creighton et al. | 439/660 |
| 2002/0119692 | A1 | 8/2002 | Barton | |
| 2004/0053528 | A1 | 3/2004 | Kainz et al. | |
| 2006/0193151 | A1 | 8/2006 | Quang et al. | |
| 2007/0222581 | A1 | 9/2007 | Hawkins et al. | |

(Continued)

FOREIGN PATENT DOCUMENTS

| | | |
|---|---|---|
| DE | 8716978 | 3/1988 |
| DE | 102007057404 | 5/2009 |

(Continued)

OTHER PUBLICATIONS

U.S. Appl. No. 12/899,731, entitled Outdoor Lighting System, Oct. 7, 2010.

(Continued)

*Primary Examiner* — Tulsidas C Patel
*Assistant Examiner* — Phuongchi Nguyen
(74) *Attorney, Agent, or Firm* — Pearne & Gordon LLP

(57) ABSTRACT

An electrical receptacle comprises a body comprising an opening and main terminal channels that are spaced apart from each other and from the opening. Electrically conductive main connectors are disposed in the body and spaced apart from each other. The main connectors are disposed in or in alignment with the main terminal channels. A connector is disposed in the body and includes an arcuate shape in or near the opening.

31 Claims, 14 Drawing Sheets

U.S. PATENT DOCUMENTS

| | | | |
|---|---|---|---|
| 2008/0068841 | A1 | 3/2008 | Chi et al. |
| 2009/0050785 | A1 | 2/2009 | Flaherty |
| 2009/0066258 | A1 | 3/2009 | Cleland et al. |
| 2010/0029268 | A1 | 2/2010 | Myer et al. |
| 2012/0135645 | A1 | 5/2012 | Jol |

FOREIGN PATENT DOCUMENTS

| | | |
|---|---|---|
| EP | 2149746 | 2/2010 |
| GB | 2444734 | 6/2008 |
| WO | 2009003279 | 1/2009 |

OTHER PUBLICATIONS

"EverLast Induction Lighting", EverLast Lighting, A Product of Full Spectrum Solution, Inc., Jackson, MI, 2009.
"Installation Instructions 413 Series Horizontal Luminaire", American Electric Lighting, a division of Acuity Group, Inc., Convyers, GA.
"M-250R2 Luminaire", GE Lighting Systems, Inc., 2008.
"Nema straight blade configurations", obtained from Internet 2010.
U.S. Appl. No. 13/212,712, filed Aug. 18, 2011, entitled System Assembly and Design of Photoelectric Controller Device, Inventor Jason Creighton et al.
U.S. Appl. No. 13/588,492, filed Aug. 17, 2012, entitled Controller Device, Inventor Laszlo Sandor Ilyes et al.
International Textbook Company, International Library of Technology: Principles of Telephony, p. 34-36, 1907, United Kingdom.
RCA Connectors sold in the U.S. at least as early as 2008.
Twist-Lock Halogen plug/receptacle sold in the U.S. in 1990.
International Search Report and Written Opinion Issued Apr. 4, 2012 in PCT Application No. PCT/US2011/048547.
International Search Report and Written Opinion Issued May 10, 2012 in PCT Application No. PCT/US2011/058234.
International Search Report and Written Opinion Issued Aug. 24, 2012 in PCT Application No. PCT/US2012/036204.
U.S. Appl. No. 12/959,921 entitled Dimmable Outdoor Luminaires, filed Dec. 3, 2010.

* cited by examiner

RECEPTACLE CONNECTOR BETWEEN CONTROLLER AND LIGHTING FIXTURE

CROSS-REFERENCE TO RELATED APPLICATION

This application is a Continuation-in-Part of U.S. application Ser. No. 13/101,577, filed May 5, 2011, which is incorporated herein by reference.

FIELD OF THE INVENTION

The field of the invention is electrical receptacles and in particular, a twist-lock electrical receptacle for electrically connecting a controller device with wiring of a lighting fixture.

BACKGROUND OF THE INVENTION

Lighting fixtures can be automatically switched on at dusk and off at dawn using twist-lock photoelectric controllers. The lighting fixtures may be used to light roads, parking lots and other areas outdoors. The photoelectric controller senses the intensity of the ambient light and switches the lighting fixtures on and off as appropriate. The photoelectric controllers are typically oriented so that the photocell faces North, away from direct sunlight in the Northern hemisphere (and in a southerly direction in the Southern hemisphere). It is also desired to be able to easily adjust the receptacle that receives the photoelectric controller to achieve the desired orientation.

Lighting fixtures for street lights typically include an electrical receptacle that receives the photoelectric controller that is mounted to a housing on the top of the lighting fixture. The electrical receptacle is wired to the power supply of the lighting fixture. The photoelectric controller has three main terminals that are inserted into the electrical receptacle and twisted to lock the photoelectric controller to the receptacle.

The orientation of the photoelectric controller in the Northern direction is accomplished by the use of a metal snap ring having fingers that engage the electrical receptacle and urge it toward the housing of the lighting fixture using a spring force. This is disclosed in U.S. Pat. No. 4,477,143. The electrical receptacle may be lifted up against the spring force and turned to orient the receptacle North. Circumferential holes located in an upper circular end plate of the electrical receptacle receive pins formed around an opening in the housing for securing the electrical receptacle to the housing. In another approach in which no snap ring is used, the electrical receptacle is oriented by loosening a screw in the top of the receptacle, rotating the receptacle until indicia on the receptacle points to the desired position and then re-tightening the screw.

BRIEF DESCRIPTION OF THE INVENTION

This disclosure pertains to an electrical receptacle, for example, a twist-lock receptacle, which is usually mounted on the top of a lighting fixture such as a street light or other area light. It is with regard to this mounting to the top of a lighting fixture that relational terms such as upper, lower, top and bottom are used in this disclosure. However, it should be appreciated that the receptacle could be mounted in a different orientation such that these relational terms could change and thus, these terms should not be used to limit the embodiments of this disclosure. A lower end of the receptacle is connected to power wires and a communication or signaling (e.g., dimming) circuit of a lighting fixture and an upper end of the receptacle receives the main and communication or signaling terminals of a controller device.

In general, a first embodiment of this disclosure features an electrical receptacle comprising a body comprising an opening and main terminal channels that are spaced apart from each other and from the opening. Electrically conductive main connectors are disposed in the body and spaced apart from each other. The main connectors are disposed in or in alignment with the main terminal channels. At least one second (e.g., communication) connector is disposed in the body and includes an arcuate shape in or near the opening. Reference to including an arcuate shape means including a shape in cross-section that is substantially circular (including semi-circular), only a discrete arc, or other shape that includes a non-arc shape and an arc shape. Reference to including the arcuate shape of the second connector includes tubular and/or ring shaped portions, for example. The opening can be an annular opening, a circular opening or an annular opening containing a smaller concentric circular opening, for example.

Referring to specific features of the first embodiment, the body can be formed of one piece. The body can be formed of electrically insulative material. The main terminals on the controller device can be received in the main terminal channels and the controller device can be twisted to lock the main terminals into electrical contact with the main connectors; and the circular, central communication terminal of the controller device can electrically contact the second connector throughout the twisting. The arcuate shape of the second connector can comprise an electrically conductive tubular portion and/or an electrically conductive ring shaped portion. The ring shaped portion can be disposed around the tubular portion. The body of the receptacle can be elongated and can include a second end portion at which the main terminal channels and the opening are disposed and a first end portion spaced apart from the second end portion along a longitudinal axis of the body. The main connectors can be disposed in main connector openings and the second connector can be disposed in an opening, at the first end of the body. At the second end portion the portion of the second connector located there can be smaller than the main connectors at that location and the main connectors can be disposed around the second connector. There can be at least three of the main terminal channels and the main connectors. The main terminal channels can be arcuate shaped and located circumferentially around and radially spaced from the opening at the second end portion.

Referring to a more specific aspect of the first embodiment, an electrical receptacle comprises a body comprising a centrally located communication terminal opening and arcuate shaped main terminal channels located circumferentially around and radially spaced from the communication terminal opening. Electrically conductive main connectors are disposed in the body and spaced apart from each other. The main connectors are disposed in or in alignment with the main terminal channels. At least one communication connector is centrally located in the body and includes an arc shape in or near the communication terminal opening. Any of the specific features described above with regard to the first embodiment, in any combination, can be used with this specific aspect thereof.

Referring to a second embodiment, an electrical receptacle comprises an exterior component made of electrically insulating material comprising a body having an first (e.g., insertion) end portion spaced apart from a second end portion along a longitudinal (e.g., insertion) axis. The first end portion leads into an interior of the body. At the second end portion of the body are disposed an opening and main terminal channels spaced apart from each other and from the opening. An interior component made of electrically insulating material is received along the longitudinal axis into the interior of the body. Electrically conductive main connectors are spaced apart from each other and are disposed in or in alignment with the main terminal channels. A second connector includes an arcuate shape in or near the opening. Reference to including an arcuate shape means including a shape in cross-section that is substantially circular (including semi-circular), only a discrete arc, or other shape that includes a non-arc shape and an arc shape. Reference to the arcuate shape of the second connector includes tubular and/or ring shaped portions, for example. The opening can be an annular opening, a circular opening or an annular opening containing a smaller concentric circular opening, for example.

Any of the specific features described above with regard to the first embodiment, in any combination, can be used with this second embodiment. In particular, there can be at least two components of the central connector each including an arcuate shape. The main terminal channels can be arcuate shaped and located circumferentially around and radially spaced from the opening which is centrally located at an end of the receptacle. The receptacle can comprise an elongated portion made of electrically insulating material formed integrally with the exterior component or the interior component extending from in or near the opening at the second end portion toward the first end portion. A circular plate can extend from the body at the second end portion.

A more specific aspect of the second embodiment features a receptacle that includes two pieces, an exterior and an interior component. The exterior or upper component of the receptacle made of electrically insulating material includes a cup shaped body, an end plate at one end of the body and an insertion end leading to an interior of the body spaced apart from the end plate along an insertion axis. Reference to insertion end means the end where the interior component enters the body of the exterior component. The end plate includes a central opening and main terminal channels located around the central opening. When the receptacle employs a twist-lock feature, the main terminal channels can be arcuate shaped and located circumferentially around and radially spaced from the central opening of the end plate. When the receptacle does not have a twist lock feature, the orientation and shape of the main terminal channels need not be arcuate, located circumferentially around or radially spaced from the central opening. The interior or lower component of the receptacle made of electrically insulating material is received along the insertion axis into the interior of the body. The interior component includes one or more central connector openings at the insertion end and main connector openings disposed around the central connector opening. Main electrical connectors have exterior end portions aligned with the main connector openings near the insertion end and have interior end portions in the interior of the body disposed in alignment with the main terminal channels. An elongated member made of electrically insulating material is formed integrally with the exterior component or the interior component extending from the central opening of the end plate to the central connector opening of the interior component. A first central electrical connector is disposed inside the elongated member at the central opening of the end plate and has an exterior end portion extending to the central connector opening of the interior component at the insertion end. The first central connector can have an interior substantially circular portion (e.g., a tubular portion). A second central electrical connector is disposed in the central opening of the end plate. The second central connector can have an interior substantially circular portion (e.g., a ring-shaped portion) disposed around the substantially circular portion of the first central connector. The substantially circular portions of the first and second central connectors can be concentric. The second central connector has an exterior end portion extending to the central connector opening of the interior component. The main terminals on the controller device can be received in the main terminal channels into electrical contact with the interior end portions of the main connectors (and the controller device can be twisted to lock the main terminals into the receptacle). Central terminals of the controller device electrically connect to the first and second central connectors (e.g., to the substantially circular portions of the first and second connectors) throughout and after the twisting.

It should be appreciated that reference to "end" and "end portion" (e.g., "insertion end" and "first end portion") should be given the broadest interpretation that does not limit the region described to a specific face or surface.

In one aspect, the elongated member is a tubular member integrally formed with the interior component. A collar can be formed on the end plate, protruding into the interior of the body along the insertion axis around the central opening of the end plate. The tubular member can be received in the collar so as to provide electrical insulation around the ring-shaped portion of the second central electrical connector vis-a-vis the main terminals.

In another aspect the elongated member is a tubular member integrally formed with the exterior component and extending to the central connector opening of the interior component at the insertion end. The interior component can comprise bosses or fingers protruding into the interior of the body that can engage the main connectors to prevent the main connectors from becoming detached from the main terminals.

At least one of the first or the second central connectors may be used in the receptacle to the exclusion of the other. One aspect features the electrical receptacle described above except that the second central connector may be omitted. In this case, the receptacle includes only the central electrical connector having an interior substantially circular portion (e.g., a tubular portion) disposed inside the elongated member at the central opening of the end plate. Specific features of this aspect include multiple of the central (i.e., first) connectors having the substantially circular portions. These would contact multiple pin terminals on the controller device. Also, the receptacle may include between 3-5 of each of the main connector openings, the main terminal channels and the main connectors. This would enable the use of 3-5 main terminals on the controller device. Further, the main terminal channels can be arcuate shaped and located circumferentially around and radially spaced from the central opening.

Another aspect features the electrical receptacle described above except that the first central connector may be omitted. In this aspect the central electrical connector having an interior substantially circular portion (e.g., a ring-shaped portion) is disposed around the elongated member (which need not be hollow) in the central opening of the end plate. Specific features of this aspect include between 3-5 of each of the main connector openings, the main terminal channels and the main connectors. This would enable the use of 3-5 main terminals on the controller device. Also, the main terminal channels can be arcuate shaped and located circumferentially around and radially spaced from the central opening.

A third embodiment of the invention is directed to a method of electrically connecting an electrical receptacle to a controller device. In this method, the receptacle described generally above is provided. The main electrical connectors are inserted into alignment with the main connector openings of the interior component. The interior component is positioned in the interior of the body so that the interior end portions of the main electrical connectors are positioned in alignment with the main terminal channels. The exterior end portions of the first and second central connectors extend to the central connector opening of the interior component. The main terminals on the controller device are inserted in the main terminal channels into electrical contact with the interior end portions of the main connectors. The central terminals of the controller device are inserted into contact with the first and second central connectors.

Any of the above described specific features may be used in any combination in the third embodiment of this disclosure.

Many additional features, advantages and a fuller understanding of the invention will be had from the accompanying drawings and the Detailed Description of the Invention that follows. It should be understood that the above Brief Description of the Invention describes the invention in broad terms while the following Detailed Description of the Invention describes the invention more narrowly and presents embodiments that should not be construed as necessary limitations of the broad invention as defined in the claims.

DETAILED DESCRIPTION OF THE INVENTION

Figure 1:
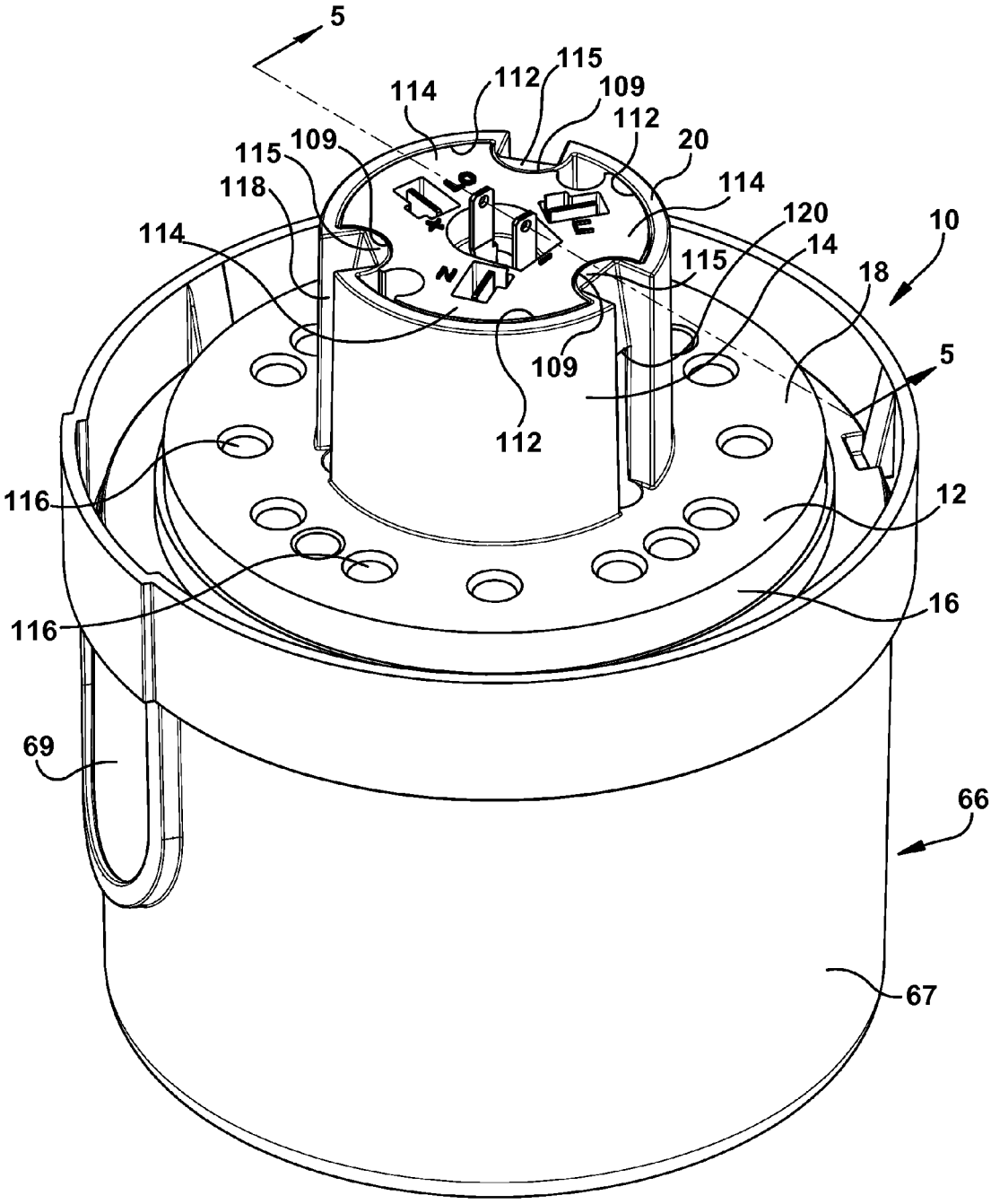
FIG. 1 is a perspective view of a controller device electrically connected to an electrical receptacle of this disclosure.
Figure 2:
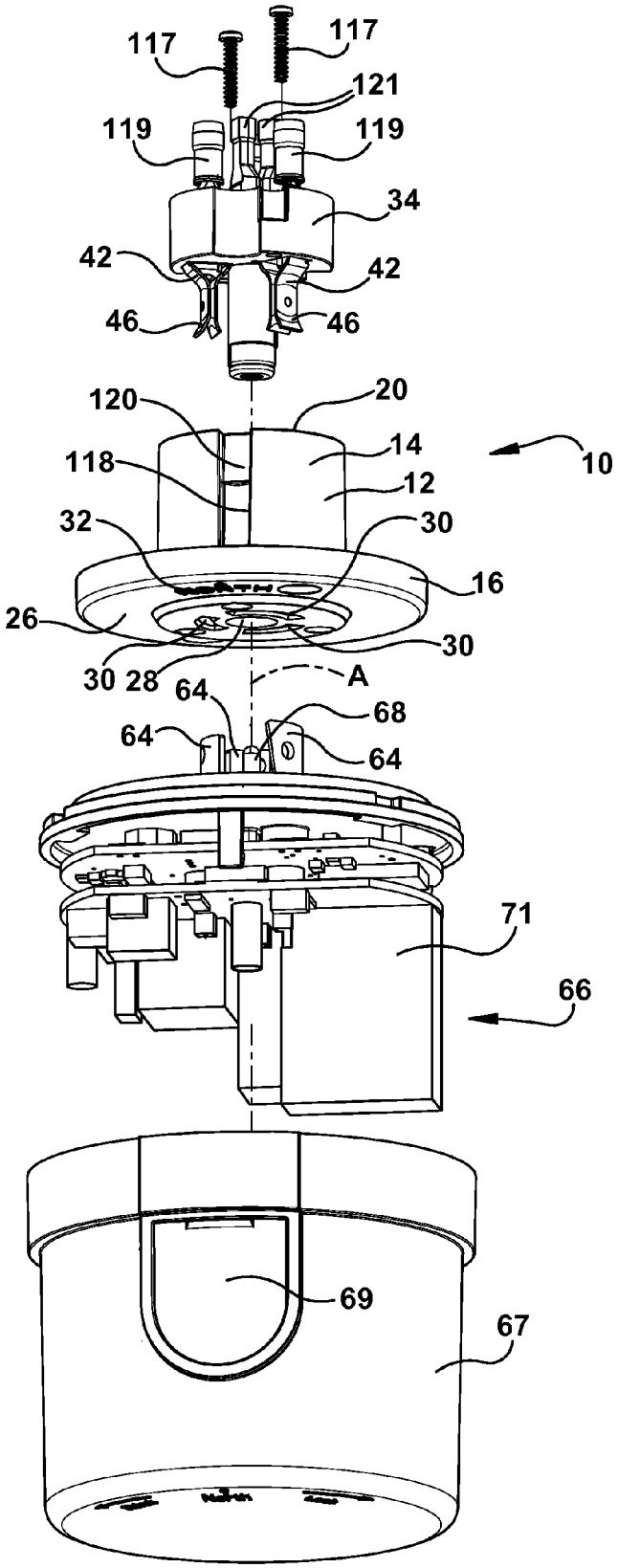
FIG. 2 is an exploded perspective view showing the controller device and interior and exterior components of the electrical receptacle.
Figure 3A:
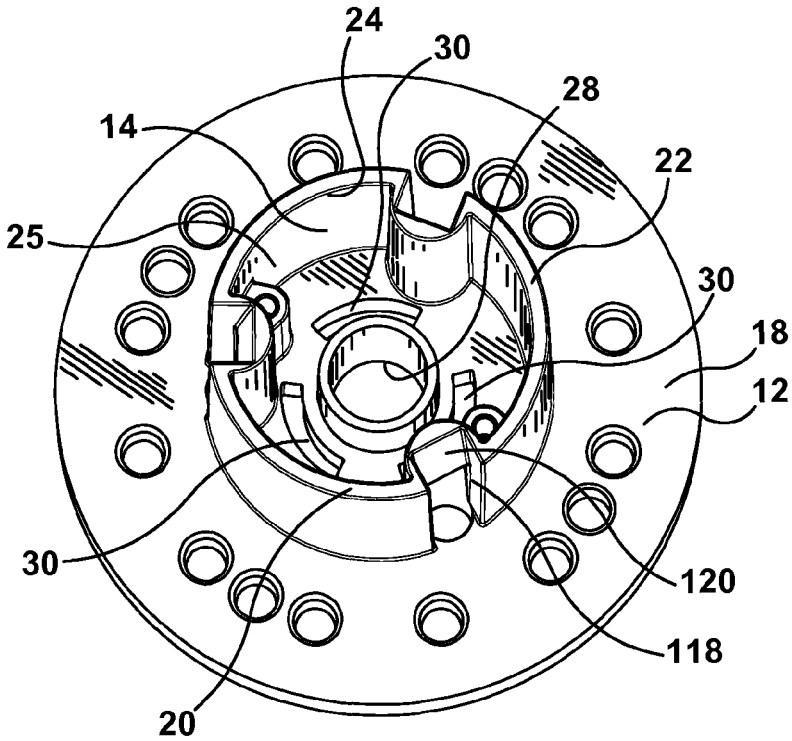
FIG. 3A is a bottom plan view and FIG. 3B is a top plan view of the exterior component.
Figure 3B:
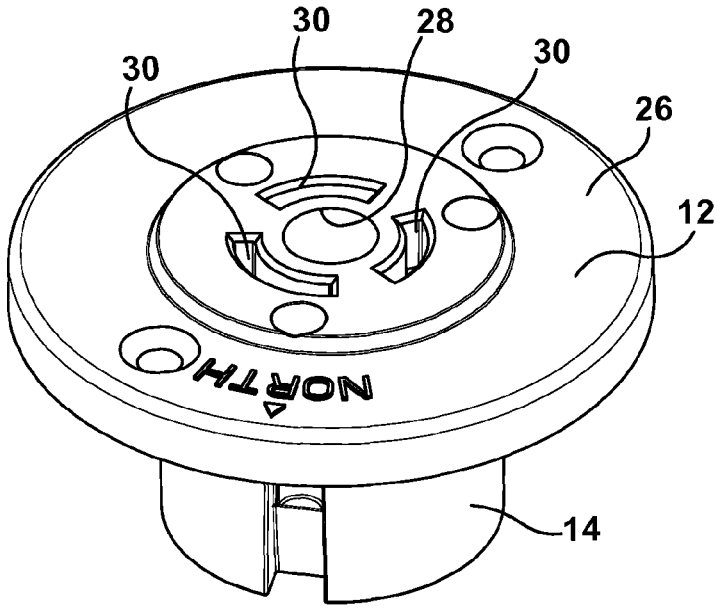
Figure 4A:
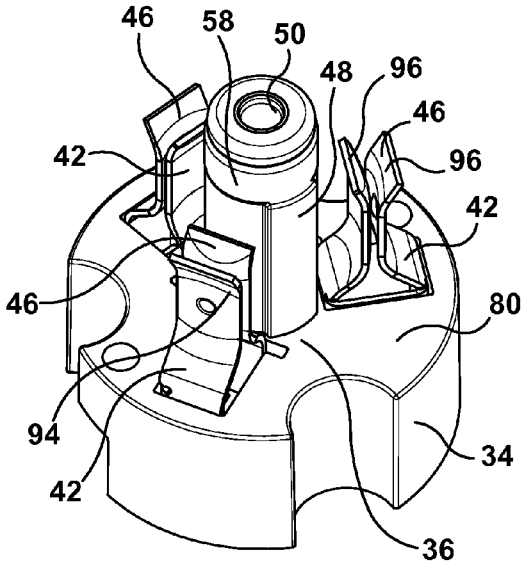
FIG. 4A is a perspective view showing a top of the interior component with its connectors in place.
Figure 4B:
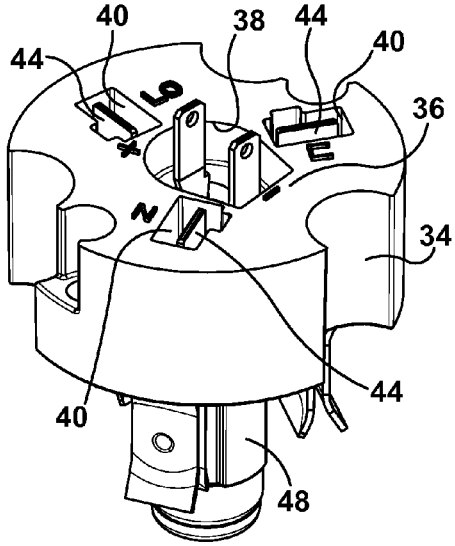
FIG. 4B is a perspective view of the bottom of the interior component with the connectors in place.
Figure 4C:
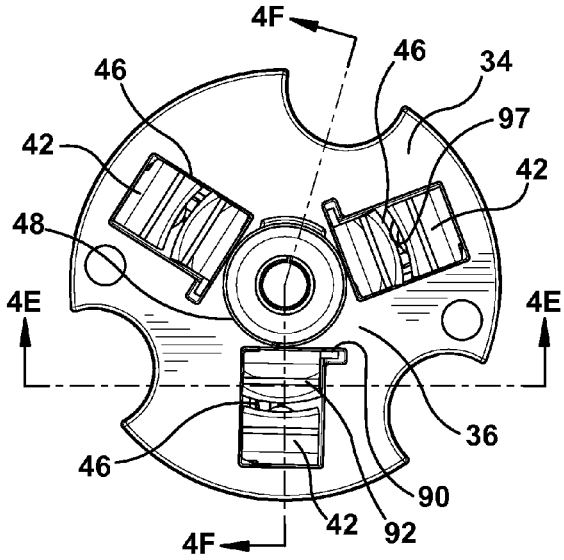
FIG. 4C is a top plan view of the interior component of FIG. 1.
Figure 4D:
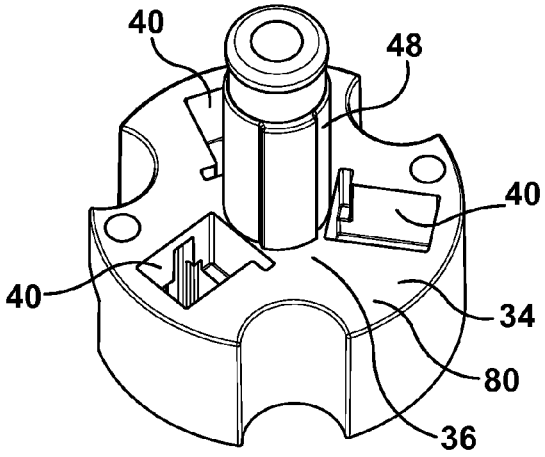
FIG. 4D is a perspective view of the interior component of FIG. 1 without its connectors in place.
Figure 4E:
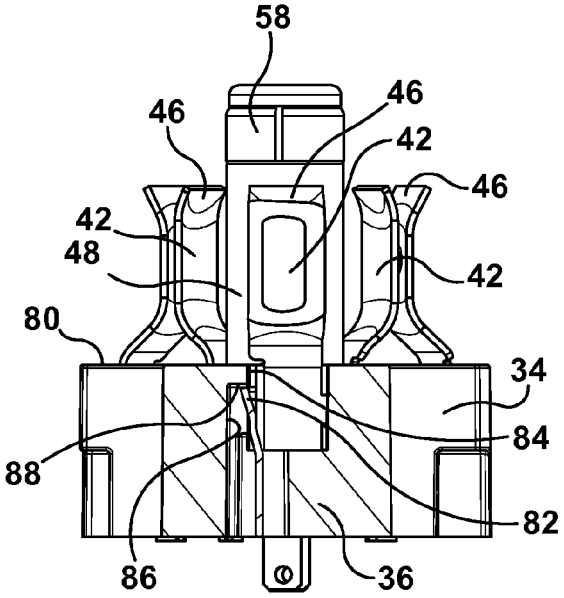
FIG. 4E is a cross-sectional view as seen from the cutting plane labeled by the arrows 4E-4E of FIG. 4C.
Figure 4F:
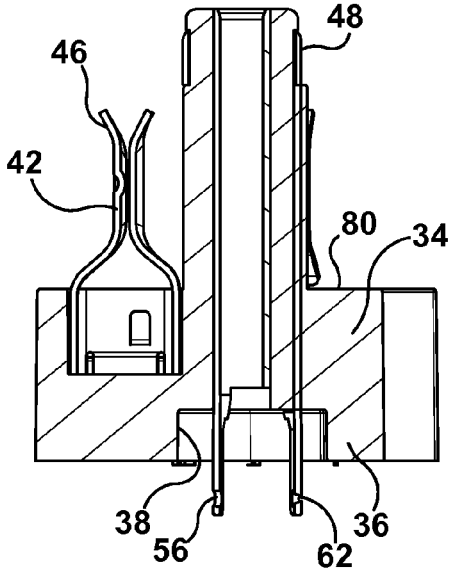
FIG. 4F is a cross-sectional view as seen from the cutting plane labeled by the arrows 4F-4F in FIG. 4C.
Figure 5:
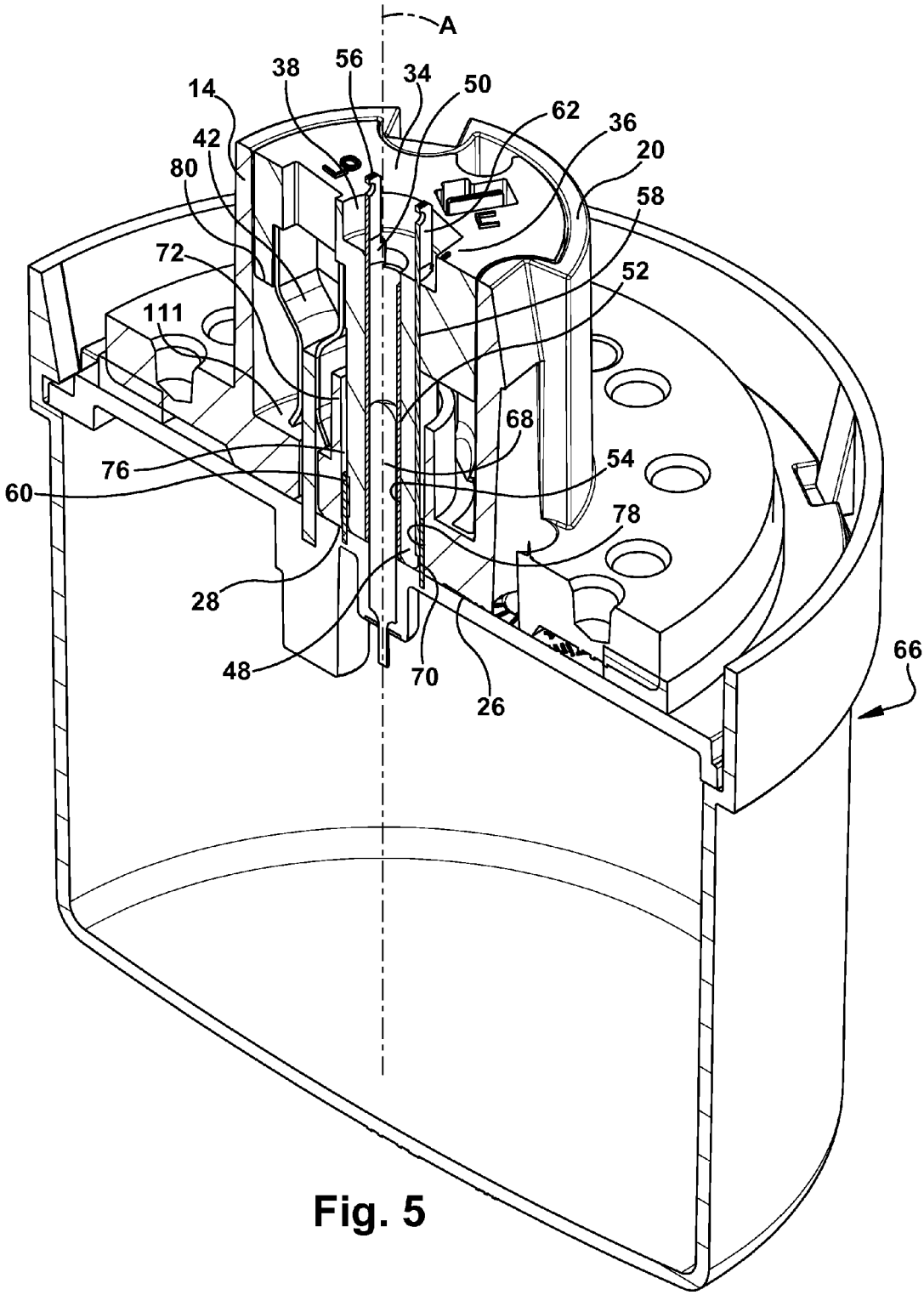
FIG. 5 is a cross-sectional view as seen from the cutting plane labeled by the arrows 5-5 of FIG. 1.
Figure 6:
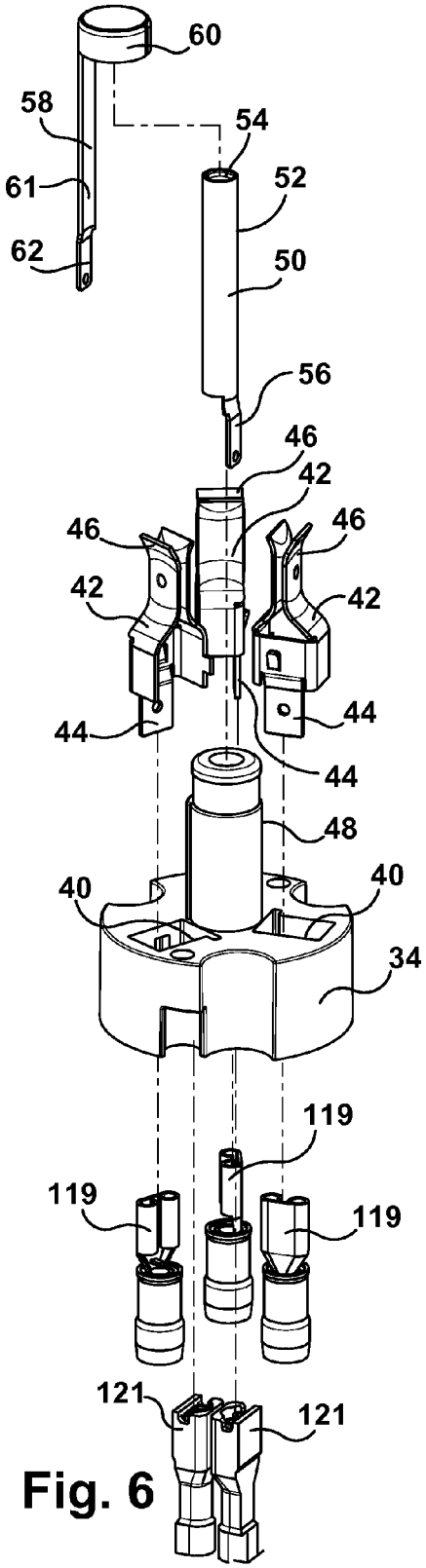
FIG. 6 is an exploded perspective view of the interior component, its connectors and the wire connectors of a lighting fixture to which it is connected.
Figure 11:
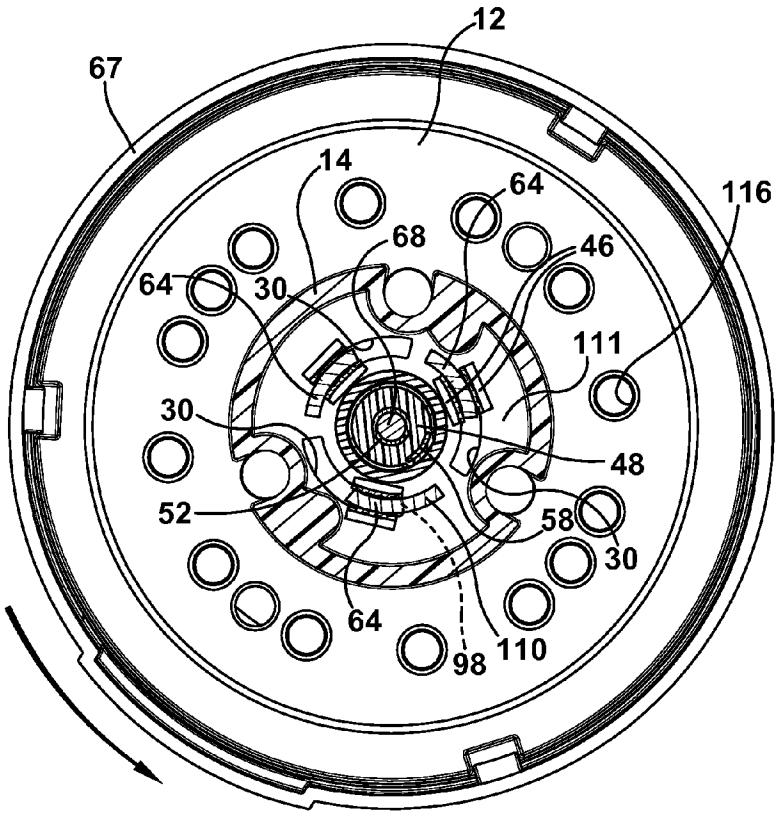
FIG. 11 is a cross-sectional view of the interior of the receptacle (at the bottom of the exterior component) taken from a cutting plane extending transverse to an insertion axis of the receptacle showing rotation of the controller device in a direction of the arrow relative to the receptacle when it is fixed in position.
Figure 10:
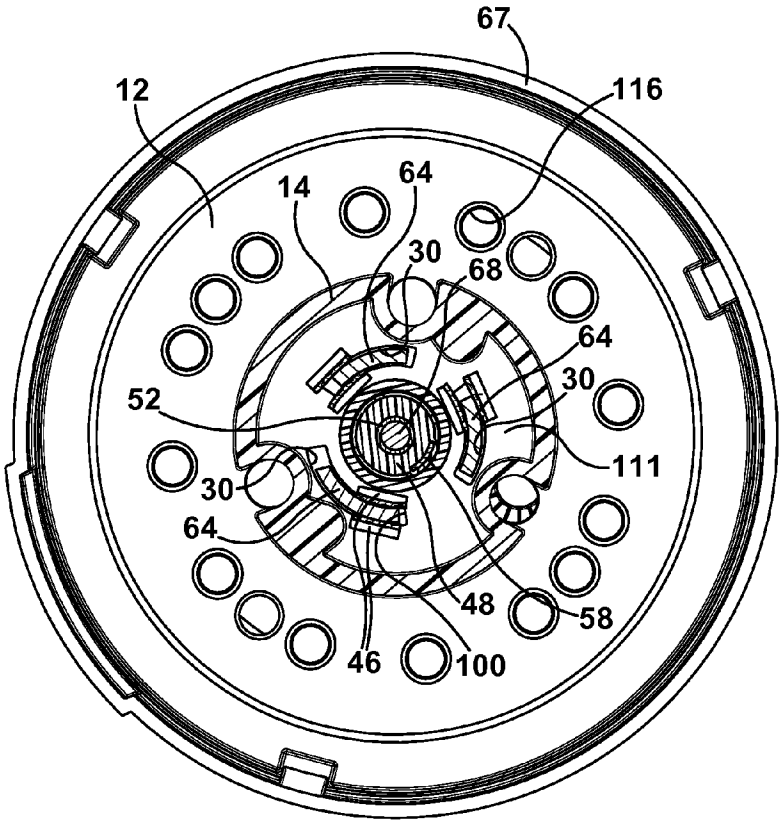
FIG. 10 is a cross-sectional view of the interior of the receptacle (at the bottom of the exterior component) taken from a cutting plane extending transverse to an insertion axis of the receptacle showing the main terminals of the controller device inserted into main terminal channels of the exterior component into contact with the main connectors.

One embodiment features a twist-lock electrical receptacle 10. An exterior component 12 of the receptacle made of electrically insulating material has a cup shaped body 14 (FIGS. 2, 3A, 3B). An end plate 16 is located at one end of the body. A lower surface 18 of the end plate is shown in FIG. 1. An insertion end 20 is spaced apart from the end plate along an insertion axis A and is located at a rim 22 forming a mouth 24 of the exterior member leading to an interior 25 of the body 14. The end plate also includes an upper surface 26. The end plate includes a central opening 28 and arcuate main terminal channels 30 located circumferentially around and radially spaced from the central opening. Referring to FIG. 2, in the position in which the receptacle is located relative to the top of the lighting fixture, the upper surface 26 of the end plate includes indicia 32 indicating North, which will be described later in this disclosure. Referring to FIGS. 2 and 4A-F, an interior component 34 of the receptacle made of electrically insulating material is received along the insertion axis A into the interior 25 of the body 14. At the insertion end the interior component 34 includes a central portion 36 including one or more signaling connector openings 38 and has main connector openings 40 radially spaced from and circumferentially disposed around the central portion (FIG. 4B). Main electrical connectors 42 have exterior end portions 44 extending in the main connector openings 40 at the insertion end and have interior end portions 46 in the interior of the body 25 disposed in alignment with the main terminal channels 30 (FIG. 5). A hollow elongated member or tube 48 made of electrically insulating material is formed integrally with the interior component 34 extending from the central opening 28 of the end plate to the central portion 36 of the interior component (FIGS. 4A and 5). Referring to FIGS. 5 and 6, a first central connector 50 has an arcuate shape, i.e., a substantially circular (e.g., tubular) portion 52, disposed inside the elongated member 48 at the central opening 28 of the end plate and extending downwardly from there along a length of the interior component, forming a cylindrical opening 54 therein, and has an exterior end portion 56 extending to the central connector opening 38 of the interior component at the insertion end 20. A second central electrical connector 58 has an arcuate shape, i.e., a substantially circular (e.g., ring-shaped) portion 60, disposed around the tubular portion 52 of the first central connector and that can be disposed in the central opening 28 of the end plate. The second central connector 58 has an exterior end portion 62 extending to the central connector opening 38 of the interior component at the insertion end 20. An elongated portion 61 of the second central connector 58 extends along a length of the interior component between the ring-shaped portion 60 and the exterior end portion 62 (FIG. 6). The second central connector 58 is embedded in the tubular member 48 along its length. Referring to FIGS. 2, 10 and 11, the main terminals 64 on controller device 66 can be received in the main terminal channels 30 and the receptacle 10 and controller device 66 can be twisted relative to each other to lock the main terminals 64 into electrical contact with the interior end portions 46 of the main connectors 42. Once the main terminals 64 of the controller device 66 have been inserted into the main terminal channels 30, a central pin signaling terminal 68 and a surrounding central ring signaling terminal 70 of the controller device electrically connect to the tubular portion 52 of the first central connector 50 and the ring-shaped portion 60 of the second central connector 58, respectively, throughout and after the twisting.

Referring to FIGS. 1 and 2, the controller device 66 includes a cover 67, a photoeye window 69 in the cover and controller electronics 71 having features including those discussed below.

Figure 12:
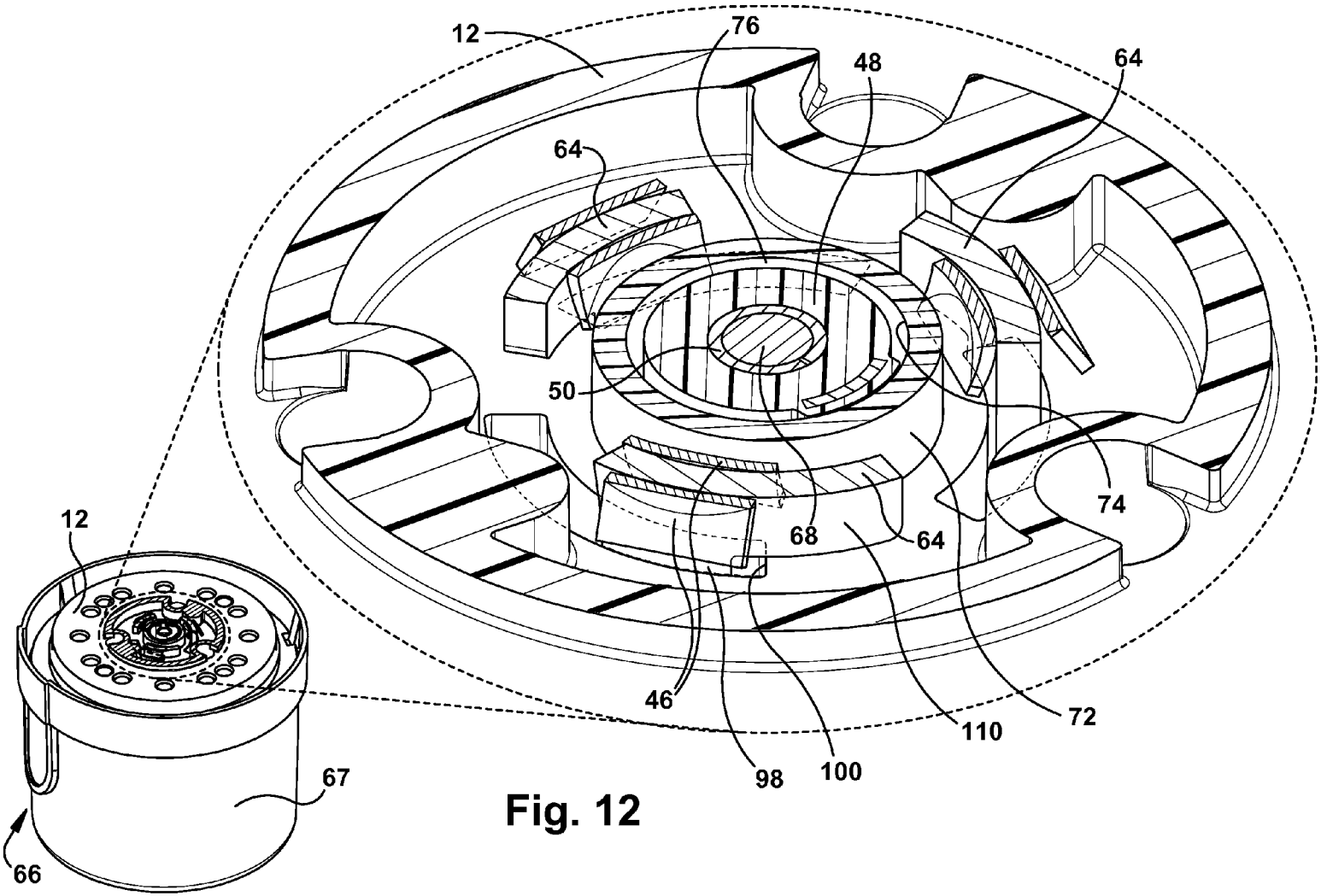
FIG. 12 is a cross-sectional, perspective view of FIG. 11.

Referring to FIGS. 5 and 12, a collar 72 can be formed on the end plate, protruding into the interior 25 of the body 14 centered along the insertion axis A, so that the wall 74 forming the internal diameter of the collar 72 is in alignment with the central opening 28 of the end plate 16. The hollow elongated member 48 on the interior component 34 can be received inside the collar 72 such that the collar provides electrical insulation around the ring-shaped portion 60 of the second central connector 58 vis-a-vis the main terminals 64 and main connectors 42.

Figure 7:
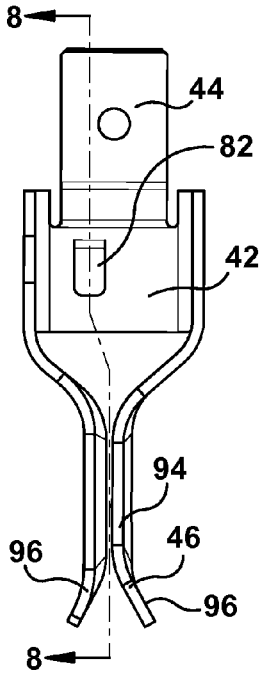
FIG. 7 is a side elevational view of a main electrical connector of the interior component.
Figure 8:
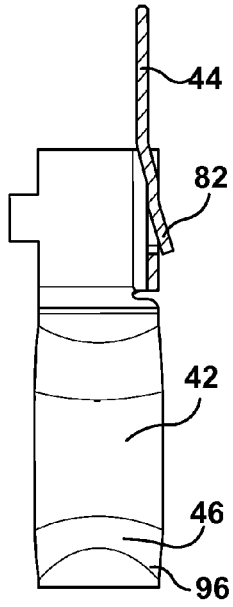
FIG. 8 is a cross-sectional view as seen from the cutting plane labeled 8-8 in FIG. 7.
Figure 9:
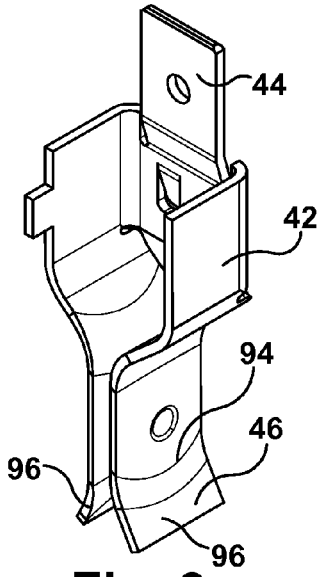
FIG. 9 is a perspective view of the main connector of FIG. 7.

Referring to FIGS. 5 and 12, when the interior component 34 including its electrical connectors is inserted into the interior of the body 14 of the exterior component 12, the tube member 48 extends into the central opening 28 of the end plate 16 so as to form an annular opening 76 between the tube and wall portion 78 of the end plate forming the central opening 28 of the end plate 16. The internal wall 74 of the collar 72 and the wall portion 78 forming the central opening 28 are coextensive. The tubular portion 52 at the interior end of the first central connector 50 can extend to the upper surface 26 of the end plate 16. The ring-shaped portion 60 of the second central connector 58 can be spaced along the insertion axis A away from the upper surface 26 of the end plate 16 toward the insertion end 20. As seen in FIG. 5, the main connectors 42 have been pushed into the interior component 34 from its upper or interior end face 80 and are locked in place. In this regard, the main connectors 42 each have a bent tab 82 that is compressed when passing through a first opening 84 (FIGS. 4E, 7 and 8) then expands into a second larger sized opening 86 formed inside the interior component, to engage a ledge 88, between openings 84, 86 which prevents removal of the main connectors 42 from the interior component when pulling on the main connectors toward the end plate. Each of the main connectors has a protrusion 90 that is received in a slot 92 in the interior component so that they can only be inserted in one orientation (FIG. 4C). Each of the main connectors 42 has a clamp portion 94 at the interior end portions 46 which is positioned in alignment with the main terminal channels 30 (FIGS. 4A, 5). The clamp portion 94 flexibly resists separation of diverging fingers 96 at the interior ends 46 of the main connectors 42, thereby forming a snug fit when the arcuate shaped main terminals 64 are received between the fingers 96 of the main connectors 42. Between the fingers may be formed an arcuate slot 97 (FIG. 4C) to receive the arcuate shaped main terminals. The controller main terminals 64 fit into the main terminal channels 30 into contact with the main connectors 42. The controller pin signaling terminal 68 fits into the cylindrical opening 54 in the tubular portion 52 of the first central connector 50. The controller ring signaling terminal 70 fits in the annular space 76 into contact with the ring shaped portion 60 of the second central connector 58. The main controller terminals 64 are P-shaped as is known in the art (FIGS. 10-12) such that when the controller device 66 is rotated relative to the receptacle 10, the controller main terminals 64 move circumferentially inside the main terminal channels 30 until a stem 98 of the main terminals contacts a side wall 100 of the main terminal channels, an overhanging portion 110 of the main terminals locking the controller device 66 to the receptacle 10 such that the controller device cannot be moved upwards along the insertion axis A.

The receptacle 10 includes three of the main connectors 42 and the central connectors include at least the tubular portion 52 of the first central connector 50 and the ring portion 60 of the second central connector 58 for a total of at least 5 electrical connections through the receptacle between the terminals of the controller device and the wiring of the lighting fixture. Additional signaling terminals on the controller device and connectors in the receptacle could be used such as by adding further concentric conductive rings.

Recesses 112 formed in the body 14 can receive protrusions 114 of the interior component 34. As shown in FIG. 1, these protrusions 114 can take the form of three semi-circular major lobes and are spaced apart from each other by inwardly projecting, smaller semi-circular portions 115 of the body 14. The interior component includes recesses 109 that receive these smaller semi-circular portions 115. Contact of the major lobes 114 against the inwardly projecting portions 115 prevents rotation of the interior component in the body.

The end plate 16 can be circular and include on its lower surface 18 facing the lighting fixture, a plurality of circumferentially spaced openings 116. The exterior component 12 can include grooves 118 on an outer surface of the body 14 with stop members 120 located in the grooves. A snap ring disposed inside a housing of a lighting fixture around an opening therein has fingers that extend into the grooves 118 and engage the stop members 120 to exert a spring force that urges the receptacle 10 against the housing while permitting the receptacle 10 to be moved away from the housing and rotated to enable the receptacle to be moved to position the indicia 32 on the end plate to the Northerly direction. Further details of the fastening of an electric receptacle to the housing of a lighting fixture, suitable for use in this disclosure, are described in the U.S. Pat. No. 4,477,143 patent.

The receptacle 10 of the first embodiment is made and assembled as follows. The exterior and interior components 12, 34 of the receptacle 10 are molded from electrically insulating material, e.g., plastic, to have the features shown in the drawings. The interior component 12 is molded around the second central connector 58 so that it is in the position shown in FIGS. 4E and 5. The first central connector 50 is inserted into the opening 54 of the tubular member 52 into the position shown in FIGS. 4E and 5. The main connectors 42 are inserted into the connector openings 40 of the interior component 34 and snapped in place such that each of the tabs 82 engage the ledge 88 in the interior component (FIGS. 4C and 4E). The interior component 34 now has the connectors 42, 50, 58 fastened as shown in FIGS. 4A, 4B and 4E. The interior component 34 is inserted into the interior 25 of the body 14 of the exterior component 12 so that its protrusions 114 fit into the recesses 112 of the exterior component (FIG. 1), and screwed in place using fasteners 117 (FIGS. 1 and 2), preventing its rotation or movement and securing the tubular member 48 in the central opening 28 of the end plate 16 and the main connectors 42 in alignment with the main terminal channels 30 of the exterior component (FIG. 5). The appropriate wires of the lighting fixture, as discussed below, are fastened to the exterior end portions of the connectors 42, 50, 58 at the insertion end 20 using connectors 119 and 121, for example. The receptacle 10 is fastened to the housing of the lighting fixture using the snap ring. Once the receptacle is in place the fingers of the snap ring engage the stop members 120 in the grooves 118 of the exterior component 12. The receptacle 10 can then be pulled away from the housing 124 against the spring force and rotated, to orient the North indicia 32 on the exterior component toward the Northerly direction. The controller device 66 is then inserted into the receptacle 10 so that the controller main terminals 64 fit into the main terminal channels 30 into contact with the clamp portions 94 of the main connectors 42, the central pin terminal 68 fits into the opening 54 of the tubular portion 52 of the first central connector 50 and the controller ring shaped terminal 70 fits into the annular opening 76 so as to contact the ring shaped portion 60 of the second central connector 58. The controller device 66 is then twisted to lock the controller main terminals 64 in the main terminal channels 30, and its removal from the receptacle is prevented by the overhanging P-shaped portions 110 of the controller main terminals 64 contacting interior wall 111 of the end plate 16 (FIGS. 5, 10 and 11). Electrical contact between the first central connector 50 and the controller central pin terminal 68 and between the second central connector 58 and the controller ring terminal 70 is maintained throughout and after twisting. It should be understood that all electrical connectors and terminals discussed in this disclosure are made of a suitable electrically conductive material such as metal as known in the art.

Figure 14:
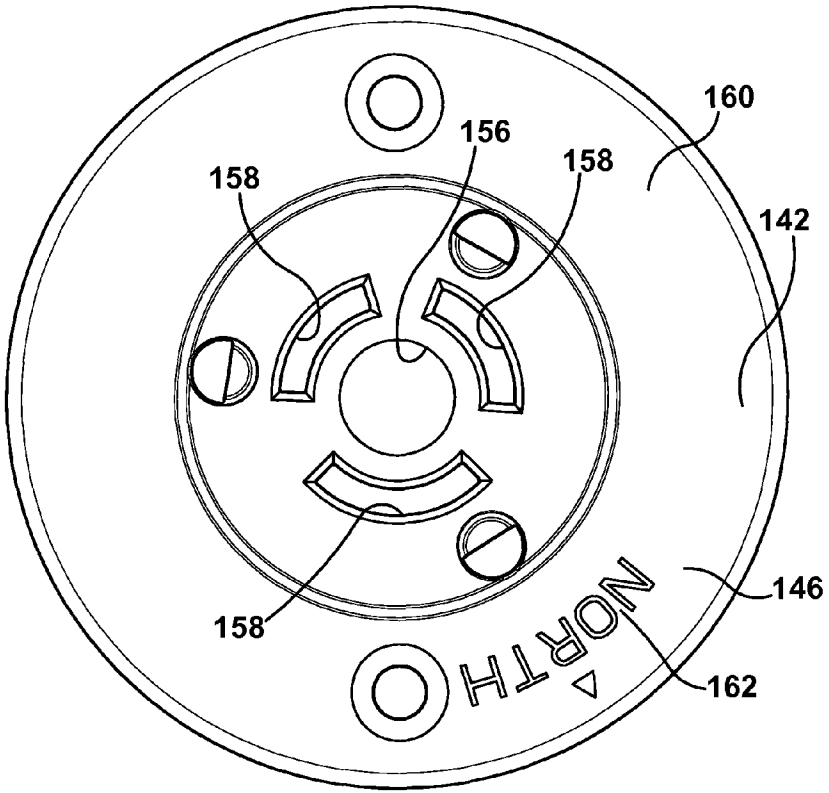
FIG. 14 is a top plan view of the receptacle of FIG. 13.
Figure 13:
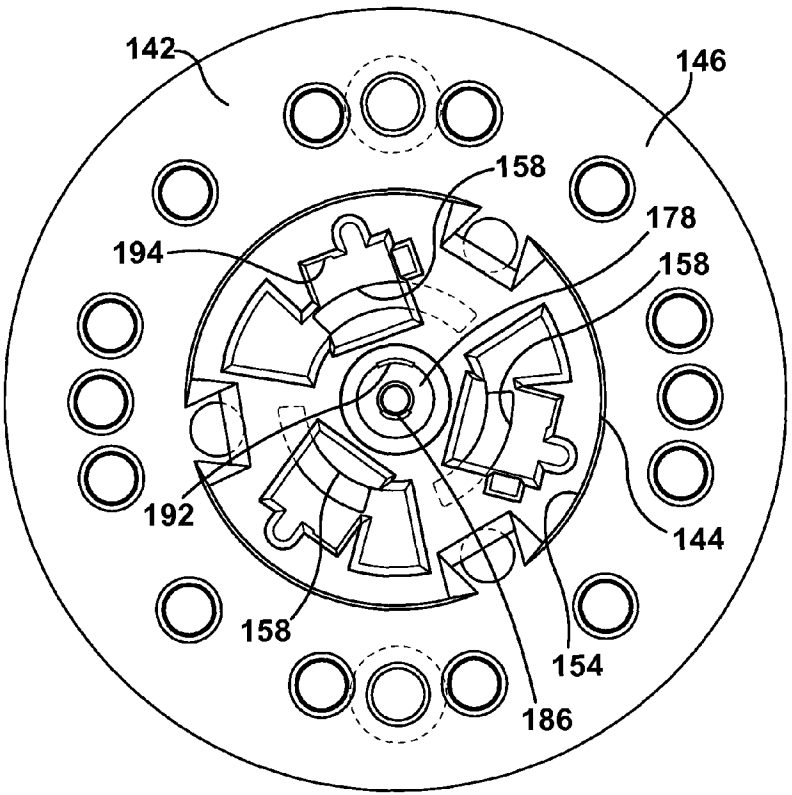
FIG. 13 is a bottom plan view of an exterior component of an electrical receptacle of a second embodiment of this disclosure.
Figure 15:
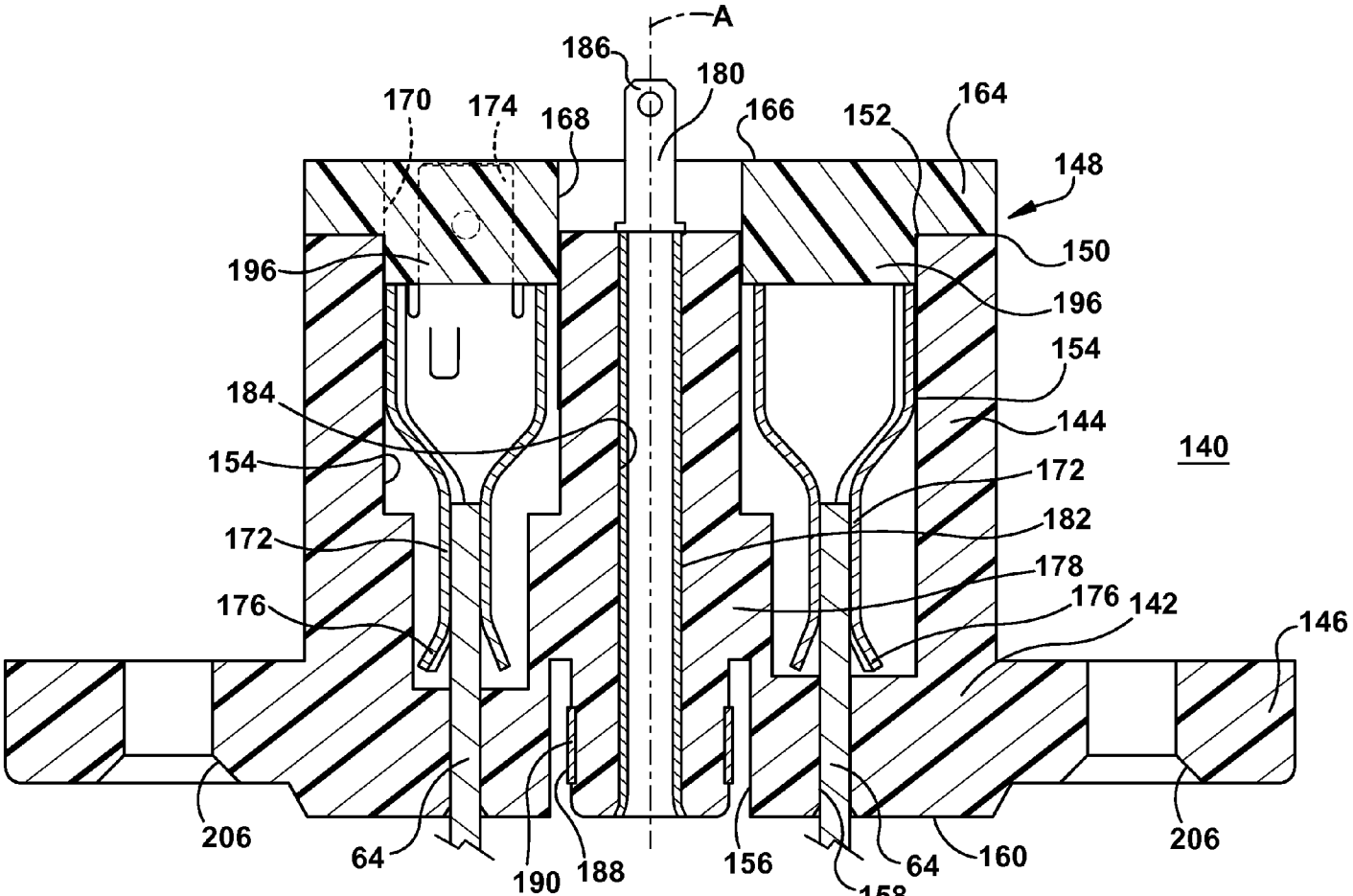
FIG. 15 is a cross-sectional view of the receptacle of FIGS. 13 and 14 when assembled.
Figure 17:
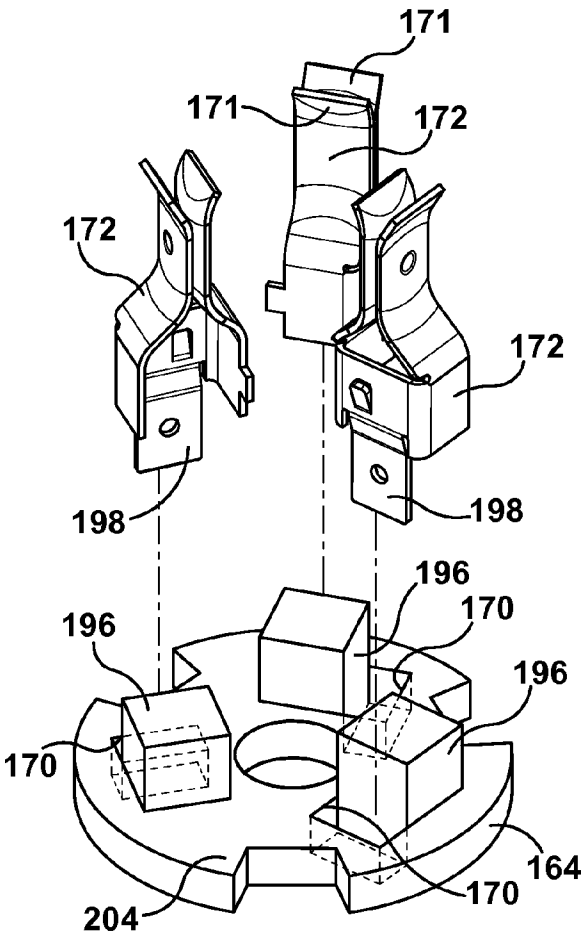
FIG. 17 is a perspective view showing the interior side of the interior component and its relationship to the main connectors.
Figure 16:
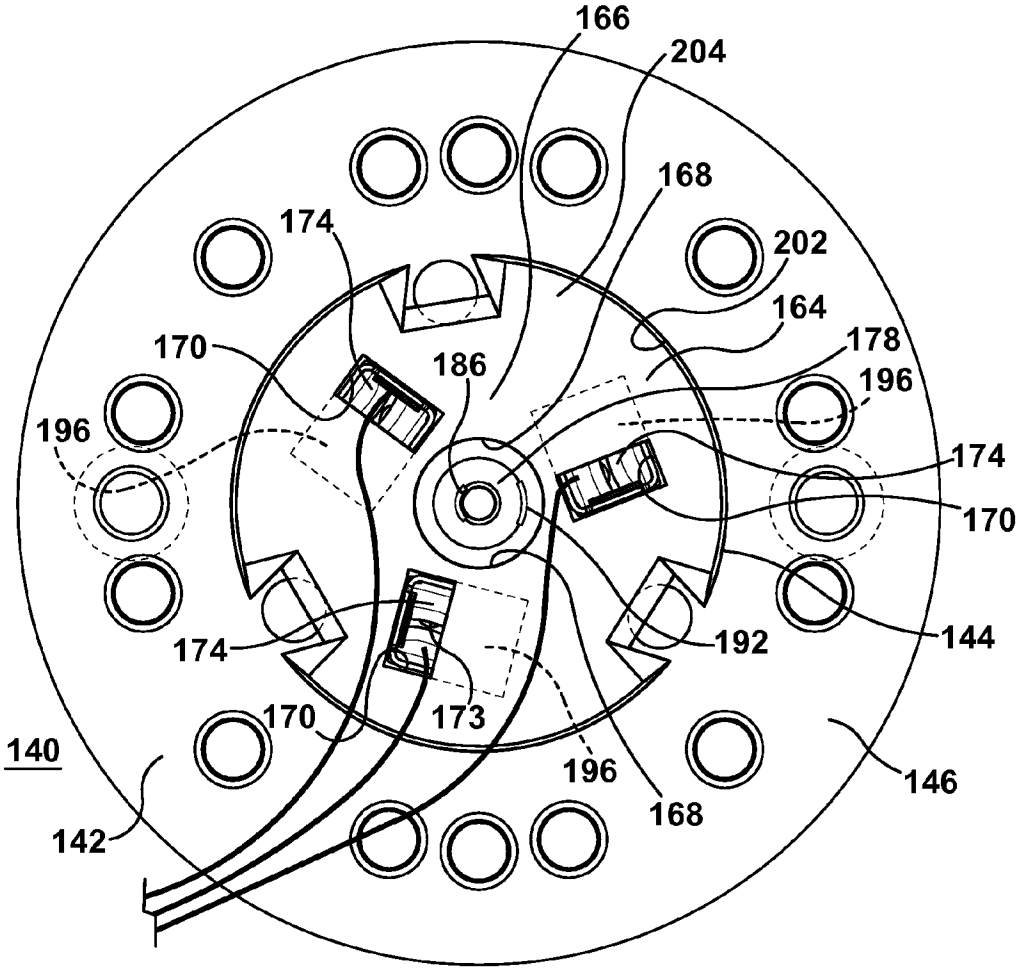
FIG. 16 is a bottom plan view of the assembled receptacle of the second embodiment.
Figure 18:
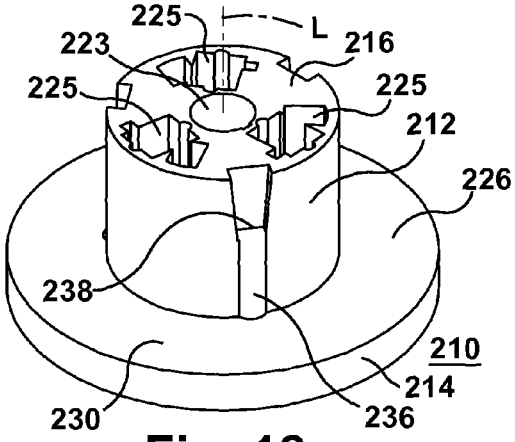
FIG. 18 is a perspective view showing a lower end portion of a one piece receptacle.
Figure 19:
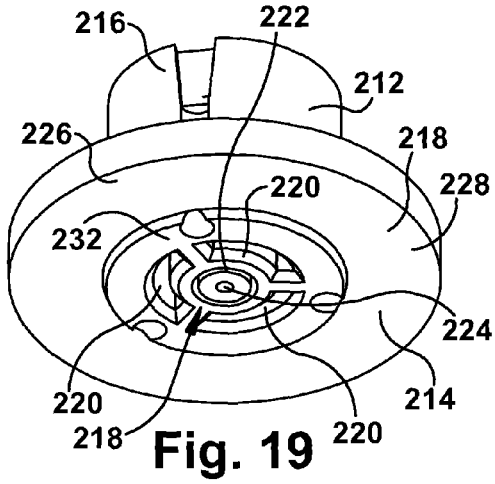
FIG. 19 is a perspective view showing an upper end portion of the receptacle of FIG. 18.
Figure 20:
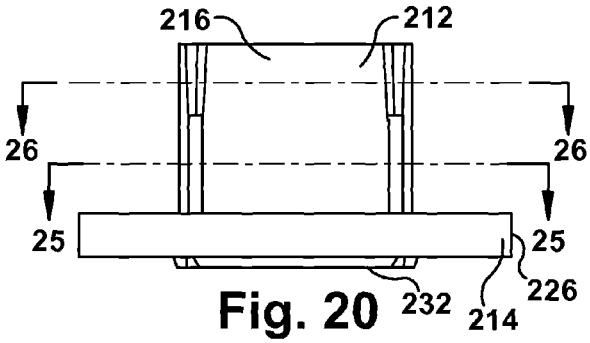
FIG. 20 is a side elevational view of the receptacle of FIG. 18.
Figure 21:
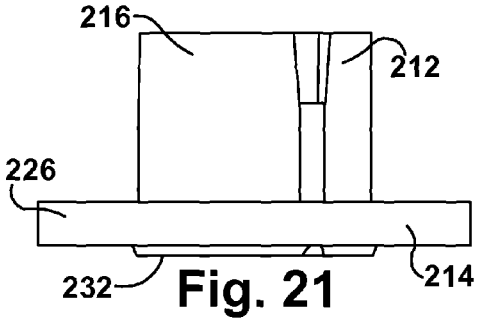
FIGS. 21 and 22 are left and right side views with respect to FIG. 20.
Figure 22:
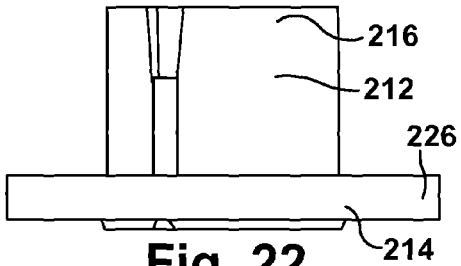
Figure 23:
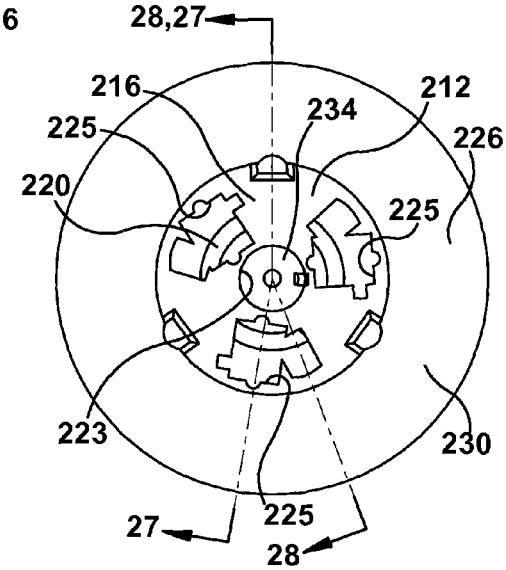
FIG. 23 is a bottom plan view of the receptacle of FIG. 20.
Figure 24:
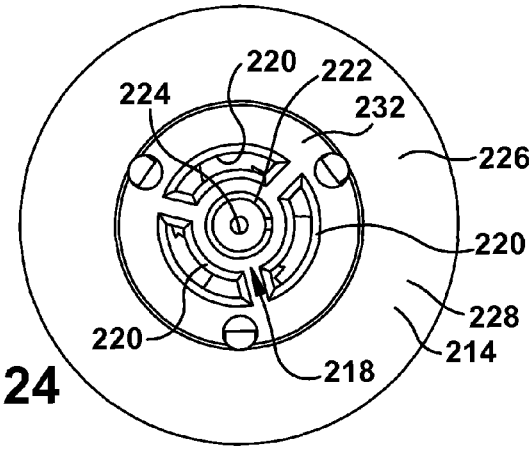
FIG. 24 is a top plan view of FIG. 20.
Figure 25:
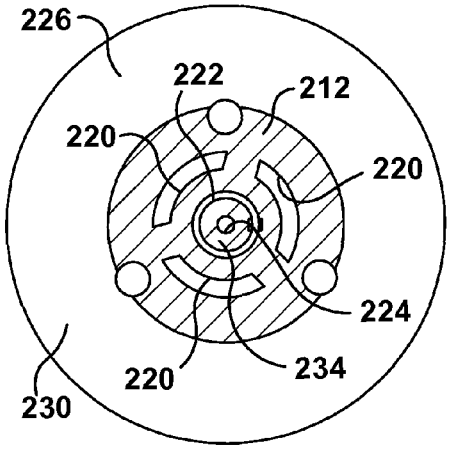
FIG. 25 is a cross-sectional view as seen from the cutting plane labeled by arrows 25-25 in FIG. 20.
Figure 26:
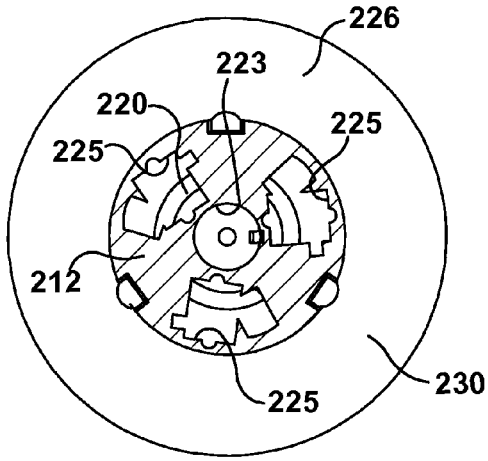
FIG. 26 is a cross-sectional view as seen from the cutting plane labeled by arrows 26-26 in FIG. 20.
Figure 27:
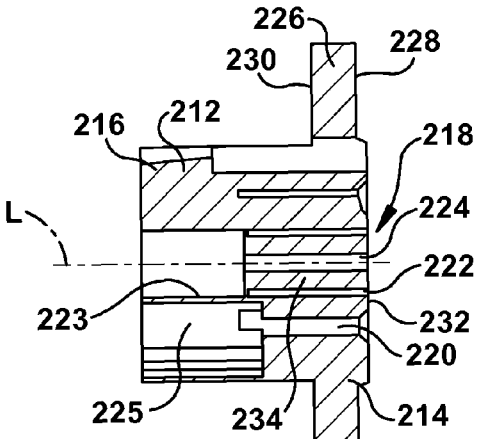
FIG. 27 is a cross-sectional view as seen from the cutting plane labeled by arrows 27-27 in FIG. 23.
Figure 28:
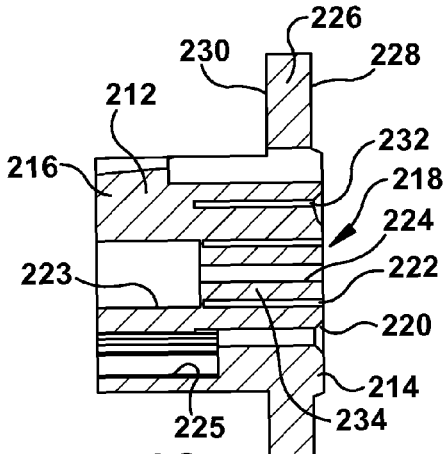
FIG. 28 is a cross-sectional view as seen from the cutting plane 28-28 in FIG. 23.

In a second embodiment of the twist-lock electrical receptacle 140, referring to FIGS. 13 and 16, an exterior component 142 of the receptacle made of electrically insulating material has a cup shaped body 144. A circular end plate 146 is located at one end of the body. An insertion end 148 is spaced apart from the end plate along an insertion axis A and is located at a rim 150 forming a mouth 152 of the exterior component 142 leading to an interior 154 of the body 144 (FIG. 15). The end plate 146 includes a central opening 156 and arcuate main terminal channels 158 located circumferentially around and radially spaced from the central opening 156 (FIGS. 14 and 15). At an upper surface 160 of the end plate 146, indicia 162 indicating North are disposed. An interior component or retainer 164 of the receptacle 140 made of electrically insulating material is received along the insertion axis A into the interior 154 of the body 144 (FIGS. 15-17). At the insertion end 148 the interior component 164 includes a central portion 166 including a central signaling connector opening 168 and main connector openings 170 circumferentially disposed around and radially spaced from the central portion 166. Main electrical connectors 172 have exterior end portions 174 that can extend in the main connector openings 170 at the insertion end 148 and have interior end portions 176 in the interior 154 of the body 144 disposed in alignment with the main terminal channels 158 (FIG. 15). Referring to FIG. 15, a hollow elongated member or tube 178 made of electrically insulating material is formed integrally with the exterior component 142 extending from the central opening 156 of the end plate 146 to the central connector opening 168 of the interior component 164. A first central electrical connector 180 has an arcuate shape, i.e., a substantially circular (e.g., tubular) portion 182, disposed inside the cylindrical interior opening 184 of the elongated member 178 at the central opening 156 of the end plate 146 (and extending along the length of the interior 154 of the body 144) and has an exterior end portion 186 extending through the central connector opening 168 of the interior component 164 at the insertion end 148. A second central electrical connector 188 has an arcuate shape, i.e., a substantially circular (e.g., ring-shaped) portion 190, disposed around the tubular portion 182 of the first central connector 180 in the central opening 156 of the end plate 146. The second central connector 188 has an elongated portion that is embedded into the tube member 178. The second central connector 188 has an exterior end portion 192 extending from the elongated portion to the central connector opening 168 of the interior component 164 at the insertion end 148 (FIG. 16). The main connectors 172 include fingers 171 at the interior end portions that can include an arcuate slot 173 between them to receive the arcuate shaped main terminals. The main terminals 64 on the controller device 66 can be received in the main terminal channels 158; and the receptacle 140 and controller device 66 can be twisted relative to each other to lock the main terminals 64 into electrical contact with the interior end portions 176 of the main electrical connectors 172. Once the main terminals 64 of the controller device 66 have been inserted into the main terminal channels 158, the central pin signaling terminal 68 and the surrounding central ring signaling terminal 70 of the controller device 66 electrically connect to the tubular portion 182 and the ring-shaped portion 190 of the first and second central connectors 180, 188, respectively, throughout and after the twisting.

Referring to FIG. 13, the exterior component 142 includes generally rectangular cavities 194 that snugly hold the interior ends 176 of the main connectors 172 in place and prevent their rotation. As shown in FIGS. 15 and 17 the interior component 164 includes fingers 196 protruding into the interior 154 of the body 144 that can engage the main connectors 172 to prevent the main connectors from becoming detached toward the bottom of the receptacle 140. Once the interior component 164 is received in the interior 154 of the body 144 it can be glued or otherwise fastened in place. Rotation of the interior member in the body can also be prevented in the manner shown in the first embodiment.

The central signaling connectors 180, 188 in the second embodiment can be the same as the central signaling connectors shown in FIG. 6. The main connectors 172 may include spades 198 as shown in FIG. 17 which can be soldered to the appropriate wires 200 of the lighting fixture. This connection between the wires 200 and tabs 198 can be located in the interior 154 of the body 144. Alternatively, the main connectors 172 can include spades at exterior end portions 174, protruding through the main connector openings 170 (FIG. 15). As shown in FIG. 16, the tubular member 178 at the insertion end 148 extends into the central opening 168 of the interior component 164, where the exterior end portions 186, 192 of the first and second central connectors 180, 188 are also disposed. The cup shaped body 144 of the exterior component 142 can also include recesses 202 and the interior component 164 can include protrusions 204 fitting into the recesses 202 at its outer periphery, which prevent rotation of the interior component 164 in the interior 154 of the body 144 of the exterior component 142.

When making and assembling the receptacle 140 of the second embodiment, the exterior component 142 is molded around the second central connector 188. The first central connector 180 is inserted into the cylindrical opening 184 of the tubular member 178. The main connectors 172 are inserted so that their interior end portions 176 fit into the cavities 194 of the exterior component 142. At this point the main connectors 172, if having a shorter spade in the interior 154 of the body 144, are already soldered or otherwise connected to the appropriate wires 200 of the lighting fixture. If the main connectors 172 are of the type shown in FIG. 17, the exterior end portions 174, e.g., spades, protrude through the main connector openings 170 formed in the insertion end 148 of the interior component 164. The interior component 164, when inserted into the interior 154 of the body 144, has the fingers 196 engaging the main connectors 172. When the interior component 164 is inserted into the interior 154 of the body 144, the exterior end portions 186, 192 of the first and second central connectors 180, 188 protrude out the central connector opening 168 of the interior component 164. The interior component 164 is fixed in place as shown in FIG. 15, such as by gluing, fastening or snapping onto the exterior component 142. The receptacle 140 is then electrically connected to the appropriate wires 200 of the lighting fixture and to the terminals of the controller device, as described above. The exemplary way the receptacle 140 is fastened to the housing 124 of the lighting fixture as shown in FIG. 15 is by screwing it in place using screws in openings 206.

Referring to FIGS. 6 and 16 in both embodiments, at the insertion end the exterior end portion of the first central connector, the exterior end portion of the second central connector and the exterior end portions of the main connectors can be rectangular shaped and referred to as spades.

Another embodiment features a one piece receptacle 210. The receptacle 210 includes a body 212 extending along a longitudinal axis L (e.g., an insertion axis as described above). The body includes a second end portion 214 (e.g., upper end portion) and a first end portion 216 (e.g., lower end portion) spaced from the second end portion along the longitudinal axis L. The body 212 comprises, at the upper end portion 214, a centrally located communication terminal opening 218 and arcuate shaped main terminal channels 220 located circumferentially around and radially spaced from the communication terminal opening 218. The communication terminal opening 218 includes an annular opening 222 and a smaller concentric circular opening 224. However, the central communication terminal opening 222 may include only the central opening 224, only the annular opening 222 or additional concentric annular openings with regard to what is shown in the drawings. Electrically conductive main connectors are disposed in the body and spaced apart from each other. The main connectors are disposed in or in alignment with the main terminal channels. At least one second or communication connector is centrally located in the body and has an arcuate (e.g., substantially circular) shape in or near the central communication terminal opening 222. The shape and position of the main connectors and second or communication connector are similar to those shown in FIGS. 15-17 and should be apparent to one of ordinary skill in the art in view of this disclosure. At the lower end portion is disposed a central opening 223 for receiving an exterior portion of the communication connector, and main connector openings 225 disposed around the central opening 223 that receive exterior portions of the main connectors.

The receptacle body is made of electrically insulating material and can be various shapes, for example, generally cylindrical. An end plate 226 extends transverse to the longitudinal axis L at the upper end portion 214 of the body 212. The end plate 226 includes upper and lower surfaces 228, 230, respectively. The central communication terminal opening 218 and the main terminal channels 220 are disposed at a center of the end plate 226 at upper surface 232 at the upper end portion 214. The main electrical connectors have exterior end portions extending in the main connector openings 225 at the lower end portion 216 of the receptacle 210 and have interior end portions in the interior of the body 212 disposed in alignment with the main terminal channels 220 (e.g., see FIGS. 15-17). The main terminal channels 220 extend from the upper surface 232 about half the length of the body 212 until reaching the main connector openings 225. The main terminal channels 220 could also be designed to receive the interior end portions of the main connectors. A hollow elongated portion or tube 234 made of electrically insulating material is formed integrally with the body 212 and extends from in or near the central communication terminal opening 218 at the upper surface 232 at the upper end portion 214 towards the lower end portion 216 for about half of the length of the body 212, for example.

The communication connector is referred to herein as a second connector and can include a first central connector and a second central connector (e.g., see FIGS. 15-17). The first central connector has an annular shape, i.e., a substantially circular (e.g., tubular) portion, disposed inside the elongated portion 234 at the central opening 224 at the upper surface 232 and extends downwardly from there along a length of the body, forming a cylindrical opening therein, and has an exterior end portion extending in the central opening 223 at the lower end portion 216. The second central electrical connector has an annular shape, i.e., a substantially circular (e.g., ring-shaped) portion, disposed around the tubular portion of the first central connector and can be disposed in the annular opening 222. The second central connector has an exterior end portion in the central opening 223 at the lower end portion 216. An elongated portion of the second central connector extends along a length of the body 212 between the ring-shaped portion and the exterior end portion (see FIGS. 15-17). The second central connector may be embedded in the tubular portion 234 along its length. The main connectors and communication connector can be molded into the body, press fit into the body or can be secured to the body using resin-thermoplastic polymer or composite cement. Or the main connectors and the communication connector can be held in place in a one-piece body with external fasteners.

The main terminals 64 on the controller device 66 can be received in the main terminal channels 220 and the receptacle 210 and controller device can be twisted relative to each other to lock the main terminals into electrical contact with the interior end portions of the main connectors. Once the main terminals 64 of the controller device 66 have been inserted into the main terminal channels 220, the central pin signaling terminal 68 and the surrounding central ring signaling terminal 70 of the controller device electrically connect to the tubular portion of the first central connector and the ring-shaped portion of the second central connector, respectively, throughout and after the twisting.

The tubular portion of the first central connector can extend to the upper surface 232 at the upper end portion 214. The ring-shaped portion of the second central connector can be spaced along the longitudinal axis L away from the upper surface 232 toward the lower end portion 216. The main connectors are pushed into the body 212 from the lower end portion 216 and are locked in place due to the shape of the main connector openings 225 and the main connector. Each of the main connectors has a clamp portion at the interior end portions which is positioned in alignment with the main terminal channels. The clamp portion flexibly resists separation of diverging fingers at the interior ends of the main connectors, thereby forming a snug fit when the arcuate shaped controller main terminals 64 are received between the fingers of the main connectors. Between the fingers may be formed an arcuate slot to receive the arcuate shaped main terminals. The controller main terminals 64 fit into the main terminal channels 220 into contact with the main connectors. The controller pin signaling terminal 68 fits into the cylindrical opening in the tubular portion of the first central connector (e.g., see FIG. 15). The controller ring signaling terminal 70 fits in the annular opening 222 into contact with the ring shaped portion of the second central connector. The main controller terminals are P or L-shaped as is known in the art (or even a straight section with a barb) such that when the controller device is rotated relative to the receptacle, the controller main terminals 64 move circumferentially inside the main terminal channels until a stem of the main terminals contacts a side wall of the main terminal channels, an overhanging portion of the main terminals locking the controller device 66 to the receptacle such that the controller device cannot be moved upwards along the longitudinal axis L.

The receptacle 210 includes three of the main connectors and the central connectors include at least the tubular portion of the first central connector and the ring portion of the second central connector for a total of at least 5 electrical connections through the receptacle between the terminals of the controller device and the wiring of the lighting fixture. Additional communication or signaling terminals on the controller device and connectors in the receptacle could be used such as by adding further concentric conductive rings.

The end plate 226 can be circular and include on its lower surface 230 facing the lighting fixture, a plurality of circumferentially spaced openings as described above. The body 212 can include grooves 236 on its outer surface with stop members 238 located in the grooves. A snap ring disposed inside a housing of a lighting fixture around an opening therein has fingers that extend into the grooves 236 and engage the stop members 238 to exert a spring force that urges the receptacle against the housing while permitting the receptacle to be moved away from the housing and rotated to enable the receptacle to be moved to position the indicia on the end plate to the Northerly direction. Further details of the fastening of an electric receptacle to the housing of a lighting fixture, suitable for use in this disclosure, are described in the U.S. Pat. No. 4,477,143 patent.

A first phase (line) wire in the lighting fixture connects the power line to a main connector spade for connection to one of the main terminals of the controller device and a second phase wire connects the power neutral to another main connector spade for connection to another main terminal of the controller device. The neutral wire also is connected to a driver or ballast in the lighting fixture. A light source is supported in the fixture housing via a socket connected with the dimming ballast or LED driver. The light source may be incandescent lamps, fluorescent lamps, high intensity discharge (HID) lamps, LEDs or arrays thereof, etc. The power line is selectively switched by the controller device and provided to the ballast or driver via a switched line wire connected to one of the main connector spades such that the ballast or driver is selectively powered or unpowered by the operation of the controller device. A dimming control signal is made by a dimming control/command component of the controller device, which is conveyed to the dimming ballast or driver within the housing. Signaling wires have connectors fastened on the wires that fasten to the exterior end portions of the first and second central connectors 50, 58 or 180, 188 for electrical connection to the signaling terminals of the controller device on one end and are electrically connected to the dimming ballast or driver at the other ends and associated dimming circuit. The controller device conveys signals to the ballast or driver that dim the lamp under certain ambient lighting conditions or otherwise as directed by the controller device. Features of the lighting fixture and the controller device are described in U.S. patent application Ser. No. 12/899,731, entitled "Outdoor Lighting System," which is incorporated herein by reference in its entirety.

As further described in the Ser. No. 12/899,731 patent application, the controller device or module includes a dimming component, which can be any suitable circuitry, hardware, processor-executed software or firmware, logic, etc., which operates to selectively provide one or more dimming control values or signals to the ballast or driver through the receptacle so as to cause the ballast or driver to provide dimmable output from the light sources. The dimming component is operatively coupled to a microcontroller of the controller device that includes a transceiver with an antenna for RF communications to one or more protocols with other RF devices, other RF-enabled fixtures, and/or with one or more RF-enabled utility meters. The microcontroller also includes a communications interface providing communications interfacing with an Internet connection bridging component and/or with a Central Data Collection Point (CDPD) modem bridging device for ultimate connection with a lighting control system. In addition, the controller device may include a Power Line Communication (PLC) transceiver and a coupling capacitance allowing the microcontroller to communicate with other lighting fixtures, meters, and/or a powerline bridge and router via signaling connections on one or both of the powerline connections. Moreover the controller device may also include current and/or voltage measurement or sensing circuitry or components for sensing input or switched power conditions for intelligent (e.g., feedback-type) dimming control.

The Ser. No. 12/899,731 patent application further describes that the controller device in certain embodiments also includes a photo sensor which senses ambient light proximate the fixture assembly and provides a sensed light signal or value to the dimming component. The dimming or signaling component selectively provides the dimming/signaling control value or values (e.g., 0-10V signal, bi-level switching, diagnostic and/or feedback messages, etc.) to the ballast or driver in certain embodiments based at least on the sensed light signal or value. This occurs, for example, through connection from the dimming or signaling control/command component of the controller device via contact between the controller central pin terminal 68 and the first central connector 50 and through connection from the dimming or signaling control/command component of the controller device via contact between the controller ring terminal 70 and the second central connector 60, and appropriate connection from the exterior end portions of the first central connector and the second central connector using wires in the lighting fixture leading to the ballast or driver (e.g., and a dimming or status signal circuit associated with it). The two signaling connections through the receptacle could include one primary signal and one standby/back-up signal, or one electrical signal and one RF signal, for example. For example, the dimming component may be programmed or otherwise configured to provide dimmed light via the dimming control value selection at dawn and/or dusk for reduced power consumption and for aesthetic lighting, rather than the conventional full on/full off operation. In certain embodiments, moreover, the dimming component may be operative to selectively dim the light output during certain times for energy conservation, for instance, to dim unused roadways to a safe but efficient level in the middle of the night, with possible dimming control modification/override according to signals or values received from an occupancy motion sensor operatively coupled with the microcontroller. In certain embodiments, moreover, the dimming control component may be implemented as one or more software components executed by the microcontroller.

As further described in the Ser. No. 12/899,731 patent application, the dimming component is operative to selectively provide the dimming control value based in part on a received RF signal or value from an external RF device. For instance, an RF command signal can be sent to the controller device wirelessly (and such signals can be sent to multiple controller devices) for initiating dimmed, full on, full off, flashing operation or combinations thereof by a control device having an RF transmitter, thus allowing security personnel to control outdoor lighting operation. The dimming component may thus provide the dimming control value(s) to control the light output according to one or more criteria, some of which may be externally actuated (via the photosensor, motion sensor, and/or RF device or combinations thereof) and some of which may be preprogrammed in the controller device.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. An electrical receptacle comprising:

a body comprising an opening and main terminal channels that are spaced apart from each other and from said opening;

electrically conductive main connectors disposed in said body and spaced apart from each other, said main connectors being disposed in or in alignment with said main terminal channels; and at least one communication connector that is disposed in said body and includes an arcuate shape in or near said opening, wherein main terminals on a device are received in said main terminal channels and said device is twisted to lock said main terminals into electrical contact with said main connectors, and a circular, central communication terminal of said device electrically contacts said communication connector throughout said twisting.

2. The electrical receptacle of claim 1 wherein said body is formed of one piece.

3. The electrical receptacle of claim 1 wherein said body is formed of electrically insulative material.

4. The electrical receptacle of claim 1 wherein said arcuate shape of said communication connector comprises an electrically conductive tubular portion.

5. The electrical receptacle of claim 1 wherein said arcuate shape of said communication connector comprises an electrically conductive ring shaped portion.

6. The electrical receptacle of claim 1 comprising at least three of said main terminal channels and said main connectors.

7. The electrical receptacle of claim 1 wherein said arcuate shape of said communication connector comprises an electrically conductive tubular portion and an electrically conductive ring shaped portion that are concentric to each other.

8. The electrical receptacle of claim 7 wherein said ring shaped portion is disposed around said tubular portion.

9. The electrical receptacle of claim 1 wherein said body is elongated and includes a second end portion at which said main terminal channels and said opening are disposed and a first end portion spaced apart from said second end along a longitudinal axis of said body.

10. The electrical receptacle of claim 9 wherein said main connectors are disposed in main connector openings and said communication connector is disposed in a communication connector opening, at said first end portion of said body.

11. The electrical receptacle of claim 9 wherein said body comprises an elongated portion made of electrically insulating material extending from in or near said opening at said second end portion toward first end portion.

12. An electrical receptacle comprising:

a body comprising an opening and main terminal channels that are spaced apart from each other and from said opening;

electrically conductive main connectors disposed in said body and spaced apart from each other, said main connectors being disposed in or in alignment with said main terminal channels; and at least one communication connector that is disposed in said body and includes an arcuate shape in or near said opening, wherein said main terminal channels are arcuate shaped and located circumferentially around and radially spaced from said opening which is centrally located in said body, wherein said main terminal channels form arcs of a reference ring that is concentric with said opening.

13. An electrical receptacle comprising:

a body comprising a centrally located communication terminal opening and arcuate shaped main terminal channels located circumferentially around and radially spaced from said communication terminal opening;

electrically conductive main connectors spaced apart from each other and disposed in or in alignment with said main terminal channels; and at least one communication connector that is centrally located in said body and includes an arcuate shape in or near said communication terminal opening, wherein main terminals on a controller device are received in said main terminal channels and said controller device is twisted to lock said main terminals into electrical contact with said main connectors, and a circular, central communication terminal of said controller device electrically contacts said communication connector throughout said twisting.

14. The electrical receptacle of claim 13 wherein said body is formed of one piece.

15. The electrical receptacle of claim 13 wherein said body is formed of electrically insulative material.

16. The electrical receptacle of claim 13 wherein said arcuate shape of said communication connector comprises an electrically conductive tubular portion.

17. The electrical receptacle of claim 13 wherein said arcuate shape of said communication connector comprises an electrically conductive ring shaped portion.

18. The electrical receptacle of claim 13 wherein said arcuate shape of said communication connector comprises an electrically conductive tubular portion and an electrically conductive ring shaped portion that are concentric to each other.

19. The electrical receptacle of claim 18 wherein said ring shaped portion is disposed around said tubular portion.

20. The electrical receptacle of claim 13 wherein said body is elongated and includes a second end portion at which said main terminal channels and said communication terminal opening are disposed and a first end portion spaced apart from said second end portion along a longitudinal axis of said body.

21. The electrical receptacle of claim 20 wherein said body comprises an elongated portion made of electrically insulating material extending from in or near said communication terminal opening at said second end portion toward first end portion.

22. The electrical receptacle of claim 20 wherein said main connectors are disposed in main connector openings and said communication connector is disposed in a communication connector opening, at said first end portion of said body.

23. An electrical receptacle comprising:

an exterior component made of electrically insulating material comprising a body having a first end portion spaced apart from a second end portion along a longitudinal axis, said first end portion leading into an interior of said body, wherein at said second end portion of said body are disposed an opening and main terminal channels spaced apart from each other and from said opening;

an interior component made of electrically insulating material that is received along said longitudinal axis into the interior of said body;

electrically conductive main connectors spaced apart from each other and being disposed in or in alignment with said main terminal channels; and a communication connector that includes an arcuate shape in or near said opening, wherein main terminals on a controller device are received in said main terminal channels and said controller device is twisted to lock said main terminals into electrical contact with said main connectors, and a circular, central communication terminal of said controller device electrically contacts said communication connector throughout said twisting.

24. The electrical receptacle of claim 23 comprising an elongated portion made of electrically insulating material formed integrally with said exterior component or said interior component extending from in or near said opening toward said first end portion.

25. The electrical receptacle of claim 23 wherein said communication connector includes at least two components each including said arcuate shape.

26. The electrical receptacle of claim 23 wherein said arcuate shape of said communication connector comprises an electrically conductive ring shaped portion.

27. The electrical receptacle of claim 23 wherein said arcuate shape of said communication connector comprises an electrically conductive tubular portion.

28. The electrical receptacle of claim 23 comprising a circular plate extending from said body at said second end portion.

29. The electrical receptacle of claim 23 wherein said arcuate shape of communication connector comprises an electrically conductive tubular portion and an electrically conductive ring shaped portion that are concentric to each other.

30. The electrical receptacle of claim 29 wherein said ring shaped portion is disposed around said tubular portion.

31. An electrical receptacle comprising:

an exterior component made of electrically insulating material comprising a body having a first end portion spaced apart from a second end portion along a longitudinal axis, said first end portion leading into an interior of said body, wherein at said second end portion of said body are disposed an opening and main terminal channels spaced apart from each other and from said opening;

an interior component made of electrically insulating material that is received along said longitudinal axis into the interior of said body;

electrically conductive main connectors spaced apart from each other and being disposed in or in alignment with said main terminal channels; and a communication connector that includes an arcuate shape in or near said opening, wherein said main terminal channels are arcuate shaped and located circumferentially around and radially spaced from said opening which is located centrally at said second end portion of said body, wherein said main terminal channels form arcs of a reference ring that is concentric with said opening.

* * * * *